United States Patent [19]

von Dreusche, Jr.

[11] 4,215,981

[45] Aug. 5, 1980

[54] HEATING OR COMBUSTION APPARATUS AND METHOD

[75] Inventor: Charles F. von Dreusche, Jr., Ramsey, N.J.

[73] Assignee: Nichols Engineering & Research Corp., Belle Mead, N.J.

[21] Appl. No.: 950,729

[22] Filed: Oct. 12, 1978

[51] Int. Cl.[2] ..... F27B 9/16

[52] U.S. Cl. ..... 432/139; 432/151; 432/235; 110/225; 202/102

[58] Field of Search ..... 432/3, 18, 131, 139, 432/142, 151, 235, 258, 264; 110/225; 202/102-104

[56] References Cited

U.S. PATENT DOCUMENTS

| | | | |
|---|---|---|---|
| 2,511,281 | 6/1950 | Martin | 432/131 |
| 3,419,254 | 12/1968 | von Dreusche, Jr. | 432/235 |
| 3,740,184 | 6/1973 | Oleszko | 432/139 |
| 3,905,757 | 9/1975 | von Dreusche, Jr. | 432/131 |
| 4,046,086 | 9/1977 | von Dreusche, Jr. | 432/139 |
| 4,115,317 | 9/1978 | Spater | 432/151 |
| 4,120,641 | 10/1978 | Myles | 432/3 |

*Primary Examiner*—Henry C. Yuen

*Attorney, Agent, or Firm*—Fitzpatrick, Cella, Harper & Scinto

[57] ABSTRACT

Furnace apparatus and method used to heat or incinerate materials which are being stirred or rabbled under atmospheres of corrosive gases, and which employs a new material of construction for fabricating rabble teeth to impart improved resistance to mechanical and thermal shock as well as improved resistance to attack by corrosive gases at elevated temperatures.

5 Claims, 2 Drawing Figures

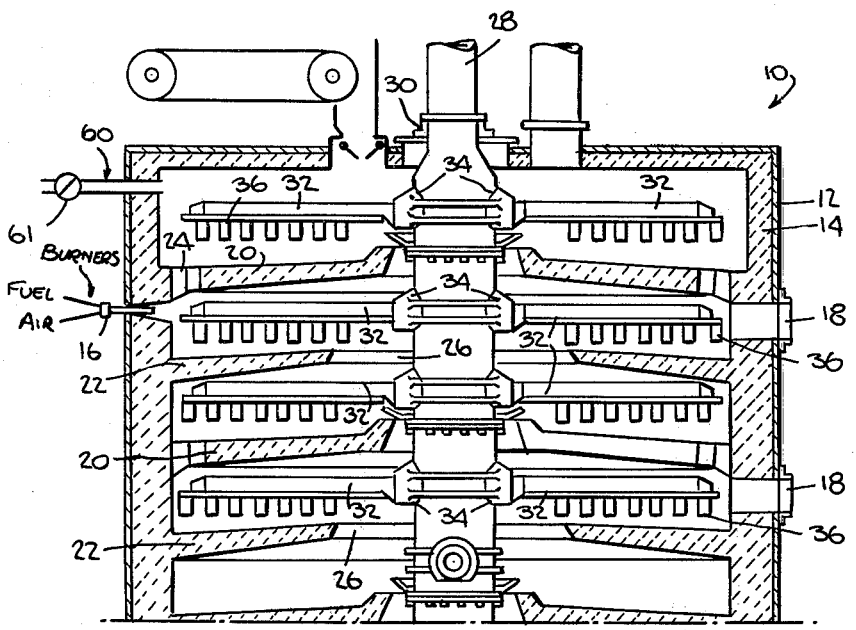
Fig. 1.
Fig. 2.
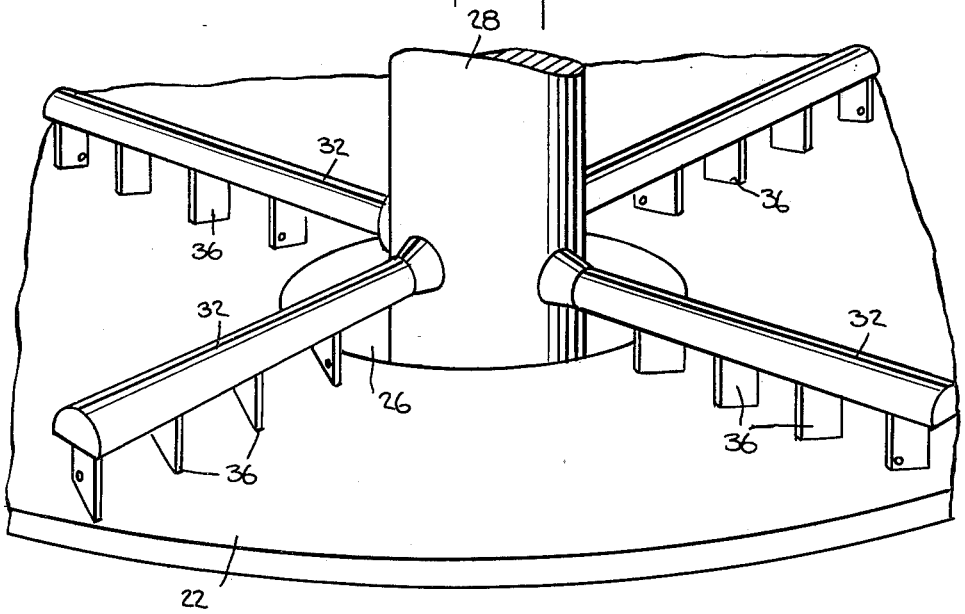

HEATING OR COMBUSTION APPARATUS AND METHOD

BACKGROUND OF THE INVENTION

1. Field of the Invention

This invention relates to heating or combustion means which utilize rabble teeth for moving and stirring the material being processed, and to a method of heating or combusting such material.

2. Description of the Prior Art

Multiple hearth furnaces such as the Herreshoff furnace are characterized by a plurality of vertically aligned hearths, or hearth chambers, down through which material being processed is moved. The temperature and atmosphere in the various hearth chambers can be controlled individually and, depending on the particular construction of the furnace, the rate of movement through it can be controlled for each hearth.

Multiple hearth furnaces of the class described may include an elongated rotatable center shaft which extends up through the center of the furnace, passing through each hearth floor. Rabble arms are secured to the center shaft and extend radially outward therefrom over each hearth floor. These rabble arms are provided with rabble teeth which extend down into the material being processed on the hearth. As the center shaft rotates, the rabble arms move over the material being processed while the rabble teeth plow through it. Depending on the angle of inclination of the rabble teeth, the material will be moved radially inwardly toward the center shaft or outwardly therefrom. Drop holes are provided in the floor of each hearth, either in toward the center shaft or out toward the furnace walls so that as the material completes its movement over the hearth it will drop down into the next lower hearth and move across this hearth in the opposite direction. Thus the material is caused to move slowly in serpentine fashion through the furnace.

The multiple hearth furnace possesses certain advantages over other solid material processing furances such as rotary kilns and the like. Thus, because these furnaces permit control of individual hearth atmospheres and temperatures, it is possible to perform very delicate operations such as regeneration of bone char and of certain granular activated carbons.

Another advantage of multiple hearth furnaces for the processing of dry solid materials lie in their ability to maintain such material in mixed condition throughout their passage through the furnace. In inclined rotary kilns, on the other hand, particles of the material being processed tend to segregate according to size, with the result that certain portions of the material have longer exposure to furnace atmospheres and temperature and consequently become processed to a different degree than other portions. The multiple hearth furnace avoids those difficulties and insures that all sizes of particles being processed receive substantially the same treatment.

Rabble teeth, as disclosed in the von Dreusche et al U.S. Pat. No. 3,402,920 have been fabricated of metal and because of the furnace atmosphere, have been subject to the action of corrosive gases. As set forth in von Dreusche U.S. Pat. No. 3,419,254, rabble teeth were constructed of ceramic material when used at very high temperature. Although the materials used for the fabrication of rabble teeth in the referred to patents have proven to be commercially desirable, more recent technological advances have opened the way for further improvements.

It is well known that when metal teeth are used in the presence of corrosive gases, deterioration may take place rapidly and therefore considerable down time for frequent replacement is necessary. The ordinarily available ceramic materials used to fabricate the rabble teeth, lack mechanical strength so that frequent replacement may also be necessary.

SUMMARY OF THE INVENTION

In view of the foregoing, I have conceived and contribute by the present invention rabble teeth for use in a heating or incinerating furnace of the Herreshoff type which have corrosion resistance superior to metal alloy teeth and improved mechanical and thermal shock resistance over ceramic teeth and which are also easily manufactured and worked to the desired shape.

I have made an investigation of the problems which result when rabble teeth fabricated of various materials of construction are subjected to corrosive atmosphere and both mechanical and thermal shock and have found a new glass-ceramic material which is easily cast or machined into the desired shapes and has the superior qualities mentioned above.

An important aspect of my invention resides in the provision, in apparatus for treating materials in a corrosive atmosphere and including a multiple hearth furnace having a plurality of vertically spaced hearths, a rotatable center shaft extending through the center of the furnace and through each hearth, at least one rabble arm secured to the center shaft and extending radially outwardly over each hearth, adjacent hearths having drop holes disposed toward the center shaft and towards the outer periphery thereof, respectively, means for heating each hearth and means for introducing material to be treated into an upper hearth; the improvement which comprises rabble teeth formed of a glass-ceramic material capable of withstanding temperatures of the order of 1800° F., said teeth depending from said rabble arms toward the surface of their respective hearth.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

DESCRIPTION OF THE PREFERRED EMBODIMENTS

Specific embodiments of the invention have been chosen for purposes of illustration and description, and are shown in the accompanying drawings forming a part of the specification wherein:

FIG. 1 is an axial, sectional elevation view of part of a multiple hearth furnace; and FIG. 2 is a perspective view of one of the hearths showing the disposition of the rabble arms and teeth.

Reverting to the drawing in detail and initially to FIG. 1, there is shown the upper portion of a multiple hearth furnace 10, of generally cylindrical configuration. This furnace is constructed of a tubular outer steel shell 12, which is lined, as indicated at 14, with fire brick or similar heat resistant material. While in some installations burner nozzles are only provided in one or two lower hearths, in the present exemplary embodiment, each hearth is provided with a plurality of burner nozzles 16 which extend both radially and tangentially into the hearth. The burner nozzles from outlets of various burner assemblies (not shown) are distributed about the furnace 10, and they serve to produce or maintain proper temperatures to carry out the particular process desired. Thus, the treated material may be subject to temperatures up to about 1800° F. and, in moving from hearth to hearth, may be subjected to rapid cooling and temperature fluctuations of the order of 600° F. to 1400° F. Additionally, there is provided on each hearth conduit means 60 and valving means 61 for introducing gases or mixtures of gases which are corrosive such as, for example, $Cl_2$ or $Cl_2$,CO, $CO_2$ and $N_2$. More specifically, I may introduce a mixture comprising 20 to 30% $Cl_2$ with the balance substantially of CO,$CO_2$ and $N_2$; or I may employ suitable valving and conduit means to maintain in selected hearths an atmosphere exceeding 0.2% $H_2S$. There are also provided special working doors and windows 18 for monitoring the operation of the furnace at each of the hearth levels.

The interior of the furnace 10 is divided by means of hearth floors 20 and 22, into a plurality of vertically aligned hearths, only four of the uppermost hearths being shown. Each of the hearth floors is made of refractory material and is preferably of slightly arched configuration to be self-supporting within the furnace. Outer peripheral dropholes 24 are provided near the outer shell 12 of the furnace and central dropholes 26 are provided near the center of the furnace in alternate hearth floors 20 and 22, respectively.

A rotatable vertical center shaft 28 extends axially through the furnace 10, and is secured by upper bearing means indicated at 30 and lower bearing means, not shown. This center shaft is rotated by suitable drive means, not shown, but well known in the art. A plurality of spaced rabble arms 32 are mounted on the center shaft 28, as at 34, and extend outwardly in each hearth over the hearth floor. The rabble arms have rabble teeth depending therefrom which teeth extend downwardly nearly to the hearth floor. The rabble teeth are inclined with respect to the longitudinal axis of their respective rabble arms so that as the rabble arms 32 are carried around by the rotation of the center shaft 28, the rabble teeth 36 will continuously rake the floor and gradually urge the material toward drop holes 24 and 26 in the hearth floors.

FIG. 2 indicates in perspective the disposition of the rabble teeth 36 with respect to the rabble arms 32 in a typical installation, the center shaft 28 and the hearth floor 22.

I have found that a glass-ceramic material having the following properties is suitable for the construction of rabble teeth according to the present invention:

| Property | Nominal Value |
|---|---|
| Density | 2.52 g/cm$^3$ |
| | 157 lb/ft$^3$ |
| Porosity | 0 |
| Water Absorption | 0 |
| Helium Permeation Rate | $4.2 \times 10^{-12} \frac{\text{cc stp-mm}}{\text{sec cm}^2\text{-cmHg}}$ |
| Volume Resistivity | $10^{14}$ ohm-cm |
| | $10^7$ ohm-cm |
| Loss Tangent | 0.003 |
| | 0.007 |
| Dielectric Constant | 5.92 |
| | 5.68 |
| Dielectric Strength | 1000 volt/mil |
| | 3000 volt/mil |
| Thermal Expansion | $94 \times 10^{-7}$/°C. |
| | $110 \times 10^{-7}$/°C. |
| | $123 \times 10^{-7}$/°C. |
| Thermal Conductivity | $0.004 \frac{\text{cal cm}}{\text{sec cm}^2\ °\text{C.}}$ |
| | $11.68 \frac{\text{BTU in}}{\text{hr.sq.ft °F.}}$ |
| Maximum Use Temp. | 1000 °C. |
| | 1832 °F. |
| Modulus of Rupture | 15,000 psi |
| Compressive Strength | 50,000 psi |
| Modulus of Elasticity | $9.3 \times 10^6$ psi |
| Shear Modulus | $3.7 \times 10^6$ psi |
| Poisson's Ratio | 0.26 |
| Knoop Hardness | 250 |
| Coefficient of Kinetic Friction | .12 |
| | .15 |
| | .15 |
| Resistance to Acid | 87 mg/cm$^2$wt loss |
| Resistance to Acid | 15 mg/cm$^2$wt loss |
| Resistance to Base | 0.12 mg/cm$^2$wt loss |
| Resistance to Base | 8.5 mg/cm$^2$wt loss |

A glass-ceramic material having the above characteristics is sold commercially by Corning Glass Works of Corning, New York under the Trademark "Macor". Applicant has found that among the foregoing properties, a nominal Knoop Hardness of about 250 and a nominal Modulus of Elasticity of about $9.3 \times 10^6$ psi are the most significant in respect of the characteristics of the glass-ceramic material for present purposes.

The following examples demonstrate the utility of this unique material.

EXAMPLE 1

A rabble tooth machined from a sheet of glass-ceramic material having the foregoing characteristics was attached to a rotating arm situated in an 18-inch mono-hearth furnace. The tooth was made to stir an inert material while exposed to a corrosive atmosphere of 24% $Cl_2$, 31% CO and 45% $N_2$, by volume, at a temperature of 1840° F. After a period of two (2) days of continuous operation under these conditions, the tooth was removed for examination.

The tooth was milk white in color at the beginning of the test and was unchanged in color at the end. There was no evidence of corrosion as demonstrated by the lack of pitting or weight loss.

Under less severe conditions of temperature (1200° F.) but using the same corrosive atmosphere, a stainless steel (type HH) rabble tooth lost 7.5% of its original weight and was observed to be severely pitted over an initial reaction period of one-half hour.

EXAMPLE 2

Two (2) samples of glass-ceramic material having the foregoing characteristics were subjected to a four (4)

hour heat treatment. One at 1900° F. and the other at 1750° F. The two samples were cooled to room temperature and then dropped onto a concrete floor from a height of four feet. Neither of the two samples damaged.

A sample of ceramic material (Castolast G) having the composition 29.2% $SiO_2$, 64% $Al_2O_3$, 0.8% $Fe_2O$, and 3.4% CaO was heated to 2000° F. After cooling to room temperature, it was dropped from a height of three feet and shattered.

EXAMPLE 3

The glass-ceramic material having the foregoing characteristics was heated to 1600° F. and transferred immediately to ambient conditions (70° F.). No observable failure was noted such as crack formation.

From general experience, the rabble teeth made from Corundal XD which has the composition 8.5% $SiO_2$, 90.8% $Al_2O_3$, 0.1% $TiO_2$, 0.2% $Fe_2O_3$, 0.07% CaO, 0.07% MgO and 0.15% ($Na_2O+K_2O+Li_2O$) have proven to be extremely fragile.

Herreshoff furnaces for use in such corrosive atmospheres would be expected to handle material at a rate of the order of 5-lb/hr-ft$^2$ and to require furnaces of roughly twenty feet in diameter having at least four hearths. The rabble teeth would be about two feet wide and one foot high and each hearth would have about twenty-four teeth. When teeth are destroyed by corrosion, not only is it costly to replace the teeth, but costly production time is also lost. From the foregoing description, it will be appreciated that the use of rabble teeth as herein described will result in lower maintenance costs and greater production.

I believe that the construction and operation of a furnace as described utilizing my novel rabble teeth will now be understood and that the advantages thereof will be fully appreciated by those persons skilled in the art.

I claim:

1. In apparatus for treating materials in a corrosive atmosphere and including a multiple hearth furnace having a plurality of vertically spaced hearths, a rotatable center shaft extending through the center of the furnace and through each hearth, at least one rabble arm secured to the center shaft and extending radially outwardly over each hearth, adjacent hearths having drop holes disposed toward the center shaft and toward the outer periphery thereof, respectively, means for heating each hearth, and means for introducing material to be treated into an upper hearth; the improvement which comprises rabble teeth formed of a glass-ceramic material having a modulus of elasticity of about $9.3\times10^6$ psi and a Knoop hardness of about 250 and capable of withstanding temperatures of the order of 1800° F., said teeth depending from said rabble arms toward the surface of their respective hearth.

2. Apparatus according to claim 1, wherein means are provided for introducing into selected of said hearths gases which are corrosive.

3. Apparatus according to claim 1, wherein means are provided for maintaining selected of said hearths in an atmosphere consisting of about 24% $Cl_2$, about 31% CO and about 45% $N_2$.

4. Apparatus according to claim 1, wherein means are provided for maintaining selected of said hearths in an atmosphere consisting of about 20–30% $Cl_2$, and the balance consisting substantially of CO, $CO_2$ and $N_2$.

5. Apparatus according to claim 1, wherein means are provided for maintaining selected of said hearths in an atmosphere exceeding 0.2% $H_2S$.

* * * * *